United States Patent [19]

Ikari et al.

[11] 4,362,571

[45] Dec. 7, 1982

[54] METHOD FOR REFINING SUGAR SOLUTIONS

[75] Inventors: Yoshikatsu Ikari, Abiko; Shiyoichiro Yokoyama, Yatabemachi; Keisuke Katoh, Matsudo; Ryutaro Itaya, Noboribetsu; Toshio Kaga, Chiba, all of Japan

[73] Assignees: Agency of Industrial Science & Technology; Sumitomo Jukikai Envirotech, Inc., both of Tokyo; Hokkaido Soda Co., Ltd., Sapporo; Mitsui Sugar Co., Ltd., Tokyo, all of Japan

[21] Appl. No.: 267,588

[22] Filed: May 27, 1981

[30] Foreign Application Priority Data

May 27, 1980 [JP] Japan ..... 55/070628

[51] Int. Cl.[3] ..... C13D 3/02; C13D 3/12

[52] U.S. Cl. ..... 127/55; 127/49; 127/50; 210/691

[58] Field of Search ..... 127/55, 50, 49; 210/777, 778, 691, 917

[56] References Cited

U.S. PATENT DOCUMENTS

| | | | |
|---|---|---|---|
| 2,261,920 | 11/1941 | Graff et al. | 127/55 |
| 2,470,202 | 5/1949 | Wickenden | 127/55 |
| 2,626,878 | 1/1953 | Bartz | 127/50 |
| 2,696,306 | 12/1954 | Gomory | 210/778 |
| 2,744,938 | 5/1956 | Urban | 210/917 X |
| 3,194,683 | 7/1965 | Grosvenor et al. | 210/917 X |
| 3,235,492 | 2/1966 | Andresen et al. | 210/778 |
| 4,163,715 | 8/1979 | Ikari et al. | 210/917 X |
| 4,196,017 | 4/1980 | Melville et al. | 127/55 X |

OTHER PUBLICATIONS

Hackh's Chemical Dictionary, 4th Ed, Grant, J., McGraw-Hill Book Co. N.Y., 1969, pp. 502, 493.

Meade-Chen., Cane Sugar Handbook, 10th Ed, John Wiley & Sons, N.Y., 1977, p. 183.

*Primary Examiner*—Kenneth M. Schor

*Attorney, Agent, or Firm*—Armstrong, Nikaido, Marmelstein & Kubovcik

[57] ABSTRACT

Disclosed is a method for refining sugar solutions with magnesia wherein magnesia used for refining of a sugar solution is calcined together with pearlite and/or diatomaceous earth at least in an amount of the same weight as that of the magnesia and the resulting calcined mixture is used for refining of the sugar solution again.

2 Claims, No Drawings

METHOD FOR REFINING SUGAR SOLUTIONS

BACKGROUND OF THE INVENTION (1) Field of the Invention

The present invention relates to a method for refining sugar solutions. More particularly, the present invention relates to a method for refining sugar solutions with magnesia in which the used magnesia is calcined and used repeatedly.

(2) Description of the Prior Art

Various methods have heretofore been proposed for refining cane juices, beet juices, liquors molasses and syrups obtained from cane, beet and raw sugar and other sugar solutions comprising sucrose as the main component.

Refining methods mainly adopted in the sugar refining process are a carbon dioxide saturation method (carbonation method), a phosphoration method, a bone black or active carbon method, an ion exchange resin method and combinations of these methods.

In the case of the carbon dioxide saturation method, since kinds of thermal energies used in sugar refining plants are expected to be increased according to location conditions of the plants, there are risks of reduction of the $CO_2$ content and incorporation of harmful substances owing to changes of compositions of chimney gases, and in a special case, it will happen that steam per se is purchased and no chimney gas is formed.

Furthermore, in order to effectively saturate a sugar solution with $CO_2$, it is necessary to control the concentration of the sugar solution below a certain critical level, and therefore, the carbon dioxide saturation method is defective in that a relatively large quantity of energy is necessary for concentration of the sugar solution.

Moreover, in the carbon dioxide saturation method, since a large quantity of lime is used, the amount of the waste cake produced is increased, disposal of the waste cake is troublesome and a problem arises in connection with prevention of environmental pollution.

The phosphoration method is defective in that since control of the reaction is difficult, decomposition of sucrose is readily caused, and that filtration of the refined sugar solution is troublesome and phosphoric acid is expensive.

The bone black method is defective in that expensive bone black should be used in large quantities and installation costs are increased.

The active carbon method is defective in that powdered active carbon is expensive. Besides, today it has grown to be difficult to obtain active carbons of a high quality due to shortage of natural resources.

The ion exchange resin method is defective in that if a sugar solution containing large quantities of impurities is passed through a column packed with an ion exchange resin without any appropriate preliminary treatment, sufficient refining of the sugar solution is not accomplished, and furthermore, this method involves such problems as insufficient passage of the sugar solution and degradation of the ion exchange resin.

SUMMARY OF THE INVENTION

The present invention has been completed as the result of our researches made with a view to overcoming the foregoing defects involved in the conventional methods for refining sugar solutions, and it provides a method for refining sugar solutions, which is much excellent over the conventional methods.

It is therefore a primary object of the present invention to provide a method for refining sugar solutions, in which refined sugar solutions having a high quality can be obtained at low costs.

A second object of the present invention is to provide a method for refining sugar solutions, in which discharge of large quantities of solid waste is almost prevented and which is advantageous in prevention of environmental pollution.

A third object of the present invention is to provide a method for refining sugar solutions, in which the steps are simplified and high energy-saving and labor-saving effects are attained.

In accordance with a fundamental aspect of the present invention, these objects can be attained by a method for refining sugar solutions with magnesia, in which the used magnesia is calcined at a relatively low temperature in the presence of pearlite and/or diatomaceous earth at least in an amount of the same weight as that of the magnesia and the calcined magnesia is used for refining of a sugar solution repeatedly.

DETAILED DESCRIPTION OF THE PREFERRED EMBODIMENTS

The method for refining sugar solutions according to the present invention comprises the steps of mixing magnesia used for refining of a sugar solution with pearlite and/or diatomaceous earth at least in an amount of the same weight as that of the magnesia, calcining the resulting mixture and using the calcined mixture of the regenerated magnesia with pearlite and/or diatomacous earth (hereinafter referred to as "calcined mixture") for refining of the sugar solution again.

At the start of the first cycle of the magnesia treatment method, magnesia alone may be used, but ordinarily, a mixture of magnesia and pearlite and/or diatomacous earth at least in an amount of the same weight as that of the magnesia is added to a sugar solution to be refined. After completion of the refining treatment, the separated used mixture of magnesia and pearlite and/or diatomaceous earth (hereinafter referred to as "used mixture") is calcined for regeneration and used again for refining of the second cycle. Then, the used mixture is similarly calcined and the calcined mixture is used for refining repeatedly.

As is seen from the foregoing description, the present invention is characterized in that used magnesia is calcined in the presence of pearlite and/or diatomaceous earth at least in an amount of the same weight as that of the magnesia and the calcined mixture is used for refining of a sugar solution repeatedly. If the amount of pearlite and/or diatomaceous earth is smaller than the amount of the used magnesia, the effect of decoloring the sugar solution and the sugar solution-filtering property are drastically reduced, and repeated use of magnesia becomes impossible.

The sugar solution to be refined according to the present invention is a sugar solution containing impurities, which is derived from cane, beet or raw sugar, especially a washed sugar solution containing impurities, which is obtained in the sugar refinary process. The solid concentration of such sugar solution is ordinarily 50 to 70% by weight.

However, in the present invention, the solid concentration of the sugar solution is not particularly critical. For example, a low-concentration solution having a BX value of about 10° and a high-concentration solution having a BX value of about 65 to 70° may be treated in the present invention. Incidentally, the BX (Brix) value indicates the amount (parts by weight) of solids contained in 100 parts by weight of the sugar solution.

Magnesia that is used in the present invention is obtained by calcining a magnesia-forming magnesium compound such as magnesium hydroxide, magnesium carbonate or basic magnesium carbonate at a temperature of 400° to 600° C. for 30 minutes to several hours, while adjusting the calcination temperature and time appropriately according to the kind of the starting magnesium compound. This magnesia has such a particle size distribution that at least 98% of particles have a size smaller than 100 mesh, especially a size smaller than 300 mesh.

Even if impurities such as aluminum oxide, calcium oxide and silicates are contained in the so-obtained magnesia, the sugar solution-refining effect or the regeneration effect is not adversely influenced.

Pearlite and diatomaceious earth that are used in the present invention are known as filter aids used in food industries. They may be used singly or in the form of a mixture thereof.

Pearlite used in the present invention has an average particle size of 2 to 20μ, preferably 4 to 15μ, and diatomaceous earth used in the present invention has an average particle size of 5 to 100μ, preferably 15 to 20μ. Such pearlite and/or diatomaceous earth is used in an amount at least one time, preferably 2 to 5 times, the amount of magnesia based on the weight (absolutely dry weight).

It is preferred that after pearlite and/or diatomaceous earth is incorporated in magnesia, the mixture be sufficiently stirred and they be used in the form of a homogeneous mixture.

The amount of the calcined mixture to be added to the sugar solution is changed according to the purity of the sugar solution and it is not particularly critical. However, it is preferred that the calcined mixture be added in an amount of about 0.5% based on the solids of the sugar solution in case of a washed sugar liquor obtained in the sugar refinary process (a solution formed by water-washing and separating molasses adhering to the surface of raw sugar by a centrifugal separator and dissolving the separated crystals in water). Even if the calcined mixture is added in an excessive amount, the amount of magnesium ions dissolved out is limited and magnesium ions are not dissolved out beyond a certain critical level (350 ppm or less as MgO based on the solids of the sugar solution). Incidentally, the lower the concentration of the sugar solution, the smaller the amount of magnesium ions dissolved out.

After the calcined mixture has thus been added to the sugar solution, the sugar solution is stirred at 50° to 90° C., preferably 75° to 85° C., for 10 minutes to 2 hours, whereby the major amounts of colloidal substances and coloring substances contained in the sugar solution are adsorbed on magnesia and are thus removed from the sugar solution.

If the treating temperature is lower than 50° C., decoloring becomes insufficient. If the treatment temperature is higher than 90° C., decomposition of sucrose occurs and the decoloring ratio is reduced, and no good results can be obtained.

The sugar solution which has been treated with the calcined mixture is alkaline because of the presence of magnesium ions dissolved out, and the pH value is ordinarily about 10. The used mixture may be separated from the sugar solution according to (1) a method in which the treated sugar solution is directly filtered or (2) a method in which a precipitate is sedimented, the supernatant is separated, the precipitated mud of the used mixture is separately filtered, the recovered filtrate is combined with the separated supernatant and the mixture is subjected to a precision filtration treatment. Even if the used mixture separated is washed with water sufficiently to recover sugar contained in the used mixture, the once adsorbed impurities and magnesia and the like are hardly dissolved out.

A coagulant may be added to the treated sugar solution when the used mixture is separated from the sugar solution. When a coagulant, preferably a natural coagulant composed mainly of chitosan, is added to the sugar solution, precipitation of the used mixture is remarkably enhanced and the used mixture is precipitated very easily. Therefore, separation and removal of the used mixture can be accomplished very effectively. In addition to the above-mentioned natural coagulant, there may be used polyacrylamide, sodium polyacrylate, a maleic acid copolymer salt and sodium alginate as the coagulant.

The separated used mixture is ordinarily dried and a small amount of fresh magnesia (less than 350 ppm as MgO based on the solids of the sugar solution) is added to the dried mixture to compensate the magnesia dissolved out in the form of magnesium ions at the refining step, and the mixture is calcined to effect regeneration. The regenerated mixture is used for refining of the subsequent cycle. Addition of fresh magnesia may be effected after calcination.

The calcination is carried out at a relatively low temperature. Namely, the calcination is conducted at 400° to 600° C., preferably 450° to 550° C. The calcination time is varied according to the calcination temperature and the degree of adsorbed organic impurities, but the calcination is ordinarily conducted for 30 minutes to 3 hours. If the calcination temperature is lower than 400° C., removal of organic substances adsorbed on the used mixture by combustion is insufficient and a long time is required for completion of this removal. On the other hand, if the calcination temperature is higher than 600° C., the adsorbing capacity of magnesia is reduced and no good results can be obtained. Magnesia, which has thus been calcined at a low temperature of 400° to 600° C., preferably 450° to 550° C., can adsorb impurities contained in the sugar solution even if it is used in a small amount, and this magnesia is especially excellent in the capacity of adsorbing colloidal substances and organic polymeric substances contained in the sugar solutions.

When magnesia having adsorbed impurities contained in the sugar solution is calcined and used repeatedly, the decoloring and filtering properties of the calcined magnesia are gradually degraded as compared with those of fresh magnesia, and therefore, refining of a sugar solution according to such adsorption-calcination method is practically impossible. It is considered that this is due to the following facts.

When a sugar solution from the sugar refinary process is refined, the reaction of adsorbing organic substances by magnesia is ordinarily carried out at a relatively high solid concentration of 50 to 70% in the sugar solution. Accordingly, the amount of organic substances adsorbed on magnesia is several times the amount of organic substances adsorbed at the customary waste water treatment. Accordingly, in order to remove these organic substances by combustion, it is necessary to supply air in an amount much larger than the amount required in the ordinary treatment, and furthermore, a longer time is required for completion of this removal. Furthermore, magnesia is locally heated at a high temperature by the heat produced by oxidative combustion of the organic substances at the time of removal of the organic substances by combustion. If such long-time calcination at such a high temperature is carried out repeatedly, crystallization of magnesia is advanced and therefore, the adsorbing capacity thereof is reduced.

In order to obviate this undersirable reduction of the adsorbing capacity, used magnesia should be calcined for a time as short as possible without local exposure to high temperatures.

The present invention has been completed based on the finding that when used magnesia is calcined in the presence of pearlite and/or diatomaceous earth at least in an amount of the same weight as that of magnesia, uniform calcination can be accomplished in a very short time at a low temperature of 400° to 600° C., and the resulting calcined mixture has excellent effects of decoloring the sugar solution and removing organic impurities and the property of filtering the sugar solution is improved. Furthermore, if the cycle of calcination of the used mixture and refining of the sugar solution by the calcined mixture is repeated, no substantial reduction of the decoloring ratio is observed.

In the sugar solution refined by the above-mentioned magnesia treatment of the present invention, major amounts of colloidal substances and polymeric coloring substances have been removed. Therefore, a lustrous sugar solution excellent in the brightness and transparency can be obtained according to the present invention. For example, when the same washed sugar liquid from the sugar refinary process is treated independently by the typical conventional method, that is, the carbonation and active carbon method, and by the magnesia treatment method of the present invention and if the turbidities of the refined sugar solutions are determined, it is seen that a certain definite turbidity is detected in the former solution but no substantial turbidity is found in the latter solution.

According to the magnesia treatment of the present invention, coloring substances contained in the sugar solution can be removed at a decoloring degree of 40 to 90%, though the attained decoloring degree differs to some extent according to the attenuation index of the sugar solution, the amount added of the calcined mixture and the treatment time.

The foregoing excellent effects attained by the magnesia treatment of the present invention have not been known at all in the art and they are quite surprising effects.

If desired, further, a sugar solution refined through the magnesia treatment according to the present invention may further be refined by means of an ion-exchange resin.

As will be apparent from the foregoing description, in the present invention, since used magnesia is calcined together with pearlite and/or diatomaceous earth at least in an amount of the same weight as that of magnesia, local exposure of the used magnesia to high temperatures by combustion of organic substances adsorbed on the magnesia can be prevented and combustion of these organic substances is completed within a short time. Therefore, crystallization of magnesia due to exposure to high temperatures is inhibited and reduction of the adsorbing capacity of magnesia is effectively prevented. Consequently, in the present invention, a mixture of magnesia with pearlite and/or diatomaceous earth can be used repeatedly, and refining of sugar solutions can be performed economically advantageously. Still further, in the present invention, since waste lime or waste active carbon is not formed, prevention of environmental contamination or pollution need not be taken into account.

Since pearlite and diatomaceous earth that are used in the present invention are cheap and easily available and they can be used repeatedly as pointed out above, the costs of refined sugar products are little influence by the use of pearlite and diatomaceous earth. Moreover, since pearlite and diatomaceous earth have a function of improving the filtering property of sugar solutions, saving of power energy and simplification of the process steps can be accomplished effectively, and sugar solutions having a high Brix value than those of refined solutions obtained according to the conventional carbon dioxide saturation method (carbonation method) can be obtained.

The foregoing excellent effects attained by the present invention cannot be expected from the known conventional techniques.

Moreover, in the present invention, amounts of wastes are very small and magnesia can be used repeatedly for a very long time. Therefore, the method of the present invention is very advantageous from the economical viewpoint, and the manufacturing cost of refined sugar can be remarkably reduced by adoption of the refining method of the present invention.

The present invention will now be described in detail with reference to the following Examples and Comparative Examples. Incidentally, in these Examples, AI values and Stammer color values (SC values) are used as the color values.

EXAMPLE 1

A starting sugar mixture of sugar produced in Australia and sugar produced in the Philippines was subjected to the washing treatment to obtain washed sugar having an AI value of 2200 (SC value of 15.5). Then, 2500 g of the so obtained washed sugar is dissolved in hot water to obtain a sugar solution having a BX value of 65°, and the sugar solution was heated at 80° C. Then, while the heated sugar solution was being stirred by a stirrer, a mixture of 10 g (0.4% based on the washed sugar) of magnesia (obtained by calcining commercially available magnesium hydroxide of the reagent grade at 500° C. for 1 hour and having an average primary particle size of 0.1 to 0.3μ and a 325 mesh-passable fraction content of 98%) and 10 g (the same weight as that of magnesia) of pearlite (supplied by Dicalite Orient Co. and having an average particle size of 4 to 15μ) was added to the sugar solution. Then, the resulting mixture was stirred at 80° C. for 30 minutes.

Then, 300 ml of the resulting suspension of magnesia and pearlite was sampled for determination of the filtering property, and all of the remainder of the suspension was filtered and the filter cake was recovered for calcination.

A pressure filter device equipped with a heater (having a filter surface of 17 $cm^2$ and including a filter paper No. 54) was charged with 300 ml of the sampled suspension, and filtration was carried out at 80° C. under a pressure of 2 kg/cm$^2$. The amount of the filtrate recovered when the filtration was conducted for 1 hour was 148 ml. The BX value of the filtrate was 65.2° and the AI value of the filtrate was 455. Namely, the decoloring ratio was $$79.3\% \left( \approx \frac{2200 - 455}{2200} \times 100 \right)$$

and the filtering property was 73 kg of washed sugar/M$^2$ ·

$$\text{Hr} \left( \approx \frac{0.148\ \text{l} \times 1.316\ \text{kg/l} \times 0.652}{1\ \text{Hr} \times (17/100000)\ \text{M}^2} \right).$$

The recovered cake (inclusive of the cake left after determination of the filtering property) was filtered and washed until the BX value of the washing liquor was reducted below 0.5°, and the washed cake was dried at 105° C. for about 16 hours.

The dried cake was charged in a crucible and calcined at 450° C. in a muffle furnace for 1 hour while taking out the crucible from the furnace and stirring the cake several times, to obtain 17 g of a calcined mixture comprising 47.5% of MgO, 51.5% of pearlite and 1% of other substances.

In order to compensate a small amount of magnesia which had been dissolved in the sugar solution, 0.64 g of magnesia was added to 16 g of the calcined mixture so that the content ratio of magnesia and pearlite was 1/1 (namely, magnesia was supplied in an amount corresponding to the amount of magnesia dissolved out).

Then, second cycle refining of the sugar solution was carried out by using this calcined mixture. Namely, 16.64 g of the calcined mixture was added to 2060 g of the same washed sugar as treated at the first cycle (the amount of magnesia was 0.4% based on the washed sugar as at the first cycle).

Then, the refining treatment was carried out in the same manner as at the second cycle, and the decoloring ratio and filtering property were determined to obtain results shown in Tables 1 and 2.

EXAMPLE 2

The refining operation was carried out in the same manner as described in Example 1 except that 30 g of pearlite (three times the amount of magnesia) was used at the first cycle. The results of the recycling tests are shown in Tables 1 and 2.

EXAMPLE 3

The refining operation was carried out in the same manner as described in Example 1 except that 10 g of diatomaceous earth (supplied by Johns Manbill Co. and having an average particle size of 15 to 20$\mu$)—the same amount as that of magnesia—was used instead of pearlite at the first cycle. The results of the recycling test are shown in Tables 1 and 2.

COMPARATIVE EXAMPLE 1

The refining operation was carried out in the same manner as described in Example 1 except that pearlite was not added and the calcination time was changed to 2 hours (calcination was not completed for 1 hour). The results of the recycling test are shown in Tables 1 and 2.

COMPARATIVE EXAMPLE 2

The refining operation was carried out in the same manner as described in Example 1 except that 5 g ($\frac{1}{2}$ of the amount used of magnesia) of diatomaceous earth (same as used in Example 3) was used at the first cycle instead of pearlite. The results of the recycling test are shown in Tables 1 and 2.

TABLE 1

| | Decoloring Ratio (%) | | | | |
|---|---|---|---|---|---|
| | Ratio of MgO and Additive | First Cycle | Second Cycle | Third Cycle | Fourth Cycle |
| Example 1 | MgO/pearlite = 1/1 | 79.3 | 79.4 | 78.9 | — |
| Example 2 | MgO/pearlite = 1/3 | 80.1 | 82.1 | 82.1 | 80.5 |
| Example 3 | MgO/diatomaceous earth = 1/1 | 79.4 | 80.3 | 78.3 | — |
| Comparative Example 1 | MgO alone | 79.5 | 44.8 | 50.2 | — |
| Comparative Example 2 | MgO/diatomaceous earth = 1/0.5 | 79.6 | 70.0 | 68.3 | — |

TABLE 2

| | Filtering Property (kg of washed sugar/M$^2$ · hr) | | | |
|---|---|---|---|---|
| | First Cycle | Second Cycle | Third Cycle | Fourth Cycle |
| Example 1 | 75 | 64 | 72 | — |
| Example 2 | 118 | 167 | 160 | 175 |
| Example 3 | 73 | 64 | 60 | — |
| Comparative Example 1 | 64 | 26 | 10 | — |
| Comparative Example 2 | 67 | 40 | 29 | — |

As will be apparent from the results shown in Tables 1 and 2, in Comparative Examples 1 and 2, which are outside the scope of the present invention, at the second and subsequent cycles, the decoloring ratio and filtering property are drastically degraded, but in Examples 1 through 3 where the calcined mixture of the present invention that is used at the first step of the present invention is employed, the decoloring ratio and filtering property are not degraded at the second and subsequent cycles but are comparable or superior to those attained at the first cycle.

Especially, in Example 2 where the magnesia/pearlite ratio is $\frac{1}{3}$, both the decoloring ratio and filtering property are enhanced, and it is apparent that the refining method of the present invention using a specific calcined mixture is very excellent.

A microscopic observation was conducted in order to examine why the decoloring ratio and filtering property are not degraded even if the specific mixture is calcined and used repeatedly according to the present invention.

In the case where pearlite or diatomaceous earth is added in a sufficient amount as in Example 2, agglomerates (secondary particles) of magnesia can crumble and magnesia is dispersed and bonded in the form of fine particles (primary particles) to the surface of pearlite or diatomaceous earth. Accordingly, such fine particles of magnesia exert an effective function for oxidation of adsorbed organic impurities of the sugar solution at the calcination step and increase the reactivity at the step of refining the sugar solution to improve the filtering property. On the other hand, in the case where the amount added of pearlite or diatomaceous earth is insufficient as in Comparative Example 2, as the operation cycles are repeated, fine particles formed by crumbling of agglomerates of magnesia tend to fill spaces of pearlite or diatomaceous earth, with the result that calcination, decoloring and filtration are not effectively accomplished.

What we claim is:

1. A method for refining sugar solutions, which comprises refining a sugar solution with magnesia to remove impurities, separating the used magnesia from the sugar solution, calcining the used magnesia together with pearlite and/or diatomaceous earth at least in an amount of the same weight as that of the magnesia, said calcining being at time and temperature sufficient to remove organic substances adsorbed on the magnesia during the refining, while retaining the adsorbing capacity of the magnesia, and using the resulting calcined mixture repeatedly for refining sugar solutions, with said calcining being performed after each refining.

2. Method for refining sugar solutions according to claim 1, wherein the calcining of the used magnesia separated from the sugar solution is carried out together with the pearlite and/or diatomaceous earth at a temperature of 400° to 600° C.

* * * * *